US005873646A

United States Patent [19]

Fjaestad et al.

[11] Patent Number: 5,873,646

[45] Date of Patent: Feb. 23, 1999

[54] LIGHTING ARRANGEMENT AT A REFRIGERATOR OR FREEZER CABINET

[75] Inventors: Adam Fjaestad, Stockholm; Thomas Ohlsson, Johanneshov, both of Sweden

[73] Assignee: Aktiebolaget Electrolux, Stockholm, Sweden

[21] Appl. No.: 822,594

[22] Filed: Mar. 20, 1997

[30] Foreign Application Priority Data

Jun. 14, 1996 [SE] Sweden ..... 9602344

[51] Int. Cl.[6] ..... F21V 33/00

[52] U.S. Cl. ..... 362/92; 362/94; 362/133; 362/125; 362/151

[58] Field of Search ..... 362/92, 94, 133, 362/125, 151, 347

[56] References Cited

U.S. PATENT DOCUMENTS

| | | | |
|---|---|---|---|
| 2,153,851 | 4/1939 | Swedman | 362/94 |
| 2,339,085 | 1/1944 | Luckiesh . | |
| 2,644,882 | 7/1953 | Voda | 362/94 |
| 2,795,691 | 6/1957 | Solley, Jr. et al. | 362/94 |
| 2,930,885 | 3/1960 | Ehrenfreund . | |
| 3,609,340 | 9/1971 | Habro | 362/347 X |
| 4,517,631 | 5/1985 | Mullins | 362/347 X |
| 4,748,543 | 5/1988 | Swarens | 362/347 X |
| 4,947,292 | 8/1990 | Vlah | 362/347 X |
| 5,032,958 | 7/1991 | Harwood | 362/347 X |
| 5,075,827 | 12/1991 | Smith | 362/347 |

*Primary Examiner*—Ira S. Lazurus
*Assistant Examiner*—David Lee
*Attorney, Agent, or Firm*—Pearne, Gordon, McCoy & Granger LLP

[57] ABSTRACT

A lamp (34) for a refrigerator or freezer cabinet is located forwardly and above a horizontal edge (38) of an access opening (16) to a storage space (12) for goods in the cabinet. The lamp (34) illuminates the space (12) through the access opening by means of a reflector (36). The reflector (36) includes a cylindrical part (52) having a semi-elliptical cross-sectional shape. A concave side of the cylindrical part (52) faces the access opening (16). The lamp has a filament (42) which shines in the shape of a line (44) running parallel to the edge (38) and through one (42) of the focal points of the ellipse. The other focal point (58) of the ellipse is located quite close to and outside the edge (38), so that the light from the filament (42) first is reflected by the cylindrical part (52) of the reflector (36) and then passes through the other focal point (58) on its way into the space (12).

8 Claims, 3 Drawing Sheets

LIGHTING ARRANGEMENT AT A REFRIGERATOR OR FREEZER CABINET

BACKGROUND OF THE INVENTION

The invention relates to a refrigerator or freezer cabinet with a lamp which, by means of a reflector with a cylindrical reflection surface, illuminates a storage space for goods in the cabinet, and wherein the lamp is arranged ahead of and above a horizontal edge of a vertical access opening to the space and illuminates the space through the access opening.

Such a cabinet is shown in U.S. Pat. No. 2,153,851. In the '851 patent, the reflector has an inverted-U cross-sectional shape. A tubular lamp, which is not specifically described in the '851 patent, is surrounded by the reflector. From FIG. 2 of the '851 patent, it appears that the reflector directs more light outside the access opening than in through the access opening.

Accordingly, there exists a need in the art for an improved illumination means for the space within the refrigerator cabinet.

SUMMARY OF THE INVENTION

The present invention is directed toward a cabinet having an improved illumination means, whereby illumination of the space within the cabinet is substantially improved over that of the prior art.

In accordance with the present invention, a reflector having a first part and a second part is secured to the refrigerator cabinet relatively above an access opening to the cabinet. The reflector at least partially surrounds a lamp having a filament defining a first line running parallel to an edge of the access opening. The reflector first part is semi-circular in cross-section, and has a concave side facing the lamp and the second part of the reflector. The reflector second part is semi-elliptical in cross-section, and has a concave side facing the access opening. The second part has first and second focal points.

In further accordance with the present invention, the first focal point of the reflector second part is on the first line defined by the lamp filament. The second focal point of the semi-elliptical second part is on a second line located close to and outside the edge. Accordingly, light from the filament is reflected by the first part of the reflector toward the lamp and the second part of the reflector, and then is reflected by the second part of the reflector through the second focal point and into the storage space.

In further accordance with the present invention, a third reflector part is provided between the first and second reflector parts. The third reflector part is semi-parabolic in cross section, and is adapted to direct a beam of parallel light rays toward a drawer which has been extended out of the storage space.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
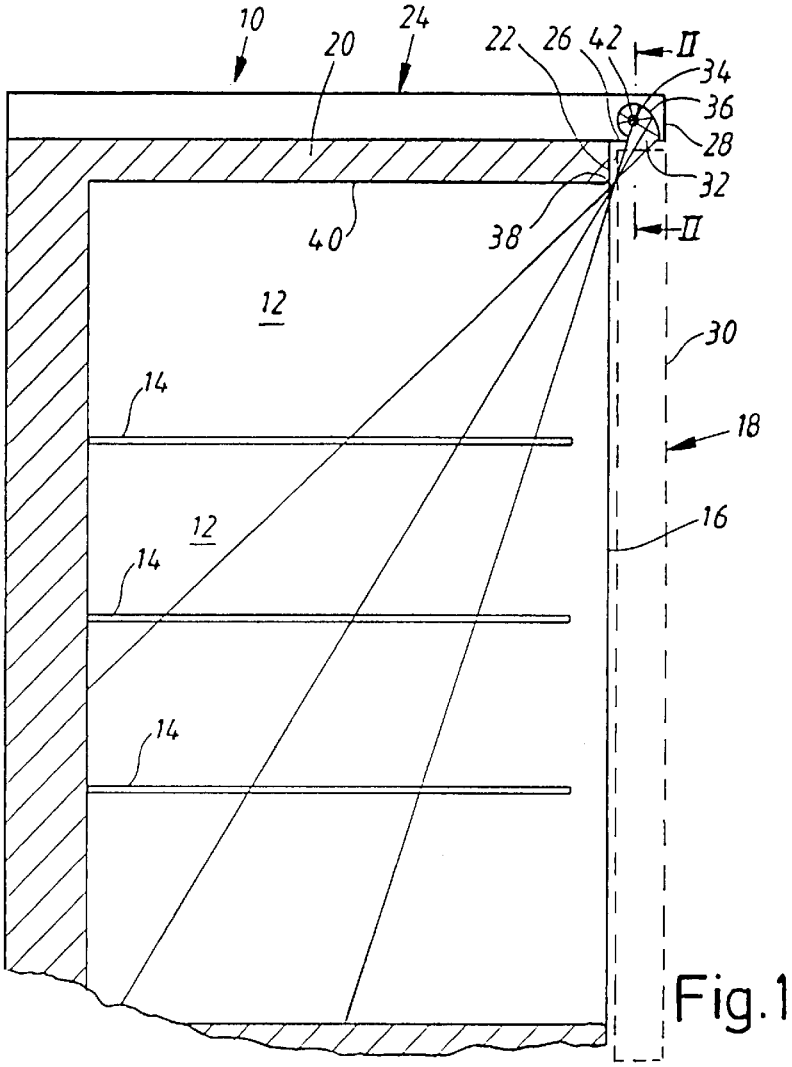
FIG. 1 is a vertical sectional view of an upper part of a refrigerator according to the present invention.

With reference to FIG. 1, a refrigerator cabinet 10 is shown to have a storage space 12 with horizontal shelves 14 for goods, which are accessible through a vertical access opening 16 of the cabinet. The shelves 14 can be constituted by transparent plates or be grill-shaped. The opening 16 is closed by a door 18 which, in a conventional manner, is rotatably journalled around a vertical axis located at one side of the opening. The space 12 has, at its top, a heat insulating roof 20.

The front of the roof 20 terminates in a planar surface 22 against which a sealing of the door 18 is intended to seal. A rectangular, plate-shaped housing 24 is arranged on top of the roof 20 and has a band-shaped, planar surface 26 which extends out from the surface 22 a distance approximately equal to the thickness of the door 18. Therefore, a front surface 28 of the housing 24 is located in substantially the same plane as the outside 30 of the door 18 when the door is closed.

A halogen lamp 34 is disposed in the housing 24 and relatively above a downwardly facing opening 32 in the surface 26, as illustrated. The halogen lamp 34, by means of a reflector 36, directs light into the space 12 through the opening 16 past a straight, horizontal edge 38 of the cabinet. The edge 38 is formed between the surface 22 and the underside 40 of the roof 20. The reflector 36 has a cylindrical reflection surface generated by lines which are parallel with the edge 38.

Figure 2:
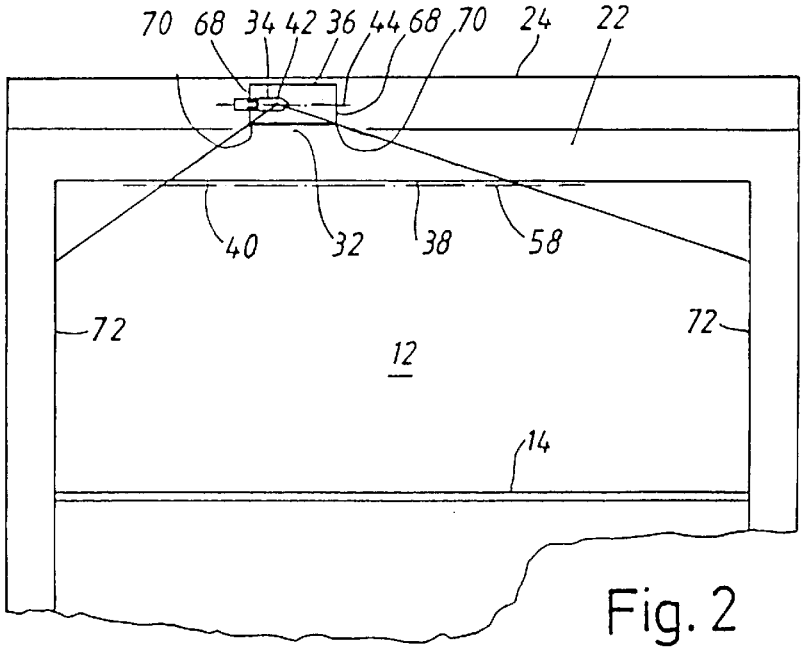
FIG. 2 is a sectional view as seen along line II—II of FIG. 1, with the lamp being constituted by a halogen lamp with a short, line-shaped filament.

As is shown best in FIG. 2, the lamp 34 has a filament 42 which shines in the shape of a straight line along a short distance of an axis 44, which also is parallel with the edge. The cylindrical reflection surface of the reflector 36 (FIG. 3) has a first, circular-cylindrical part 46, which extends from a first point 48 near an inner edge of the opening 32 to a second point 50 in the housing 24, as illustrated. The first part is semi-circular in cross section, and has its center in the filament 42.

The reflector 36 has a second, elliptical-cylindrical part 52 which extends from a third point 54 in the housing 24 to a fourth point 56 near an outer edge of the opening 32. The second part 52 is semi-elliptical in cross section, and has a first focal point in the filament 42 and a second focal point on a line 58, which is parallel with the edge 38 and located ahead of and close to the edge 38 (FIG. 2). Accordingly, light from the filament 42 shining on the first part 46 of the reflector will be reflected toward the second part 52 of the reflector which, in turn, reflects the light through the second focal point 58 and into the space 12.

Figure 3:
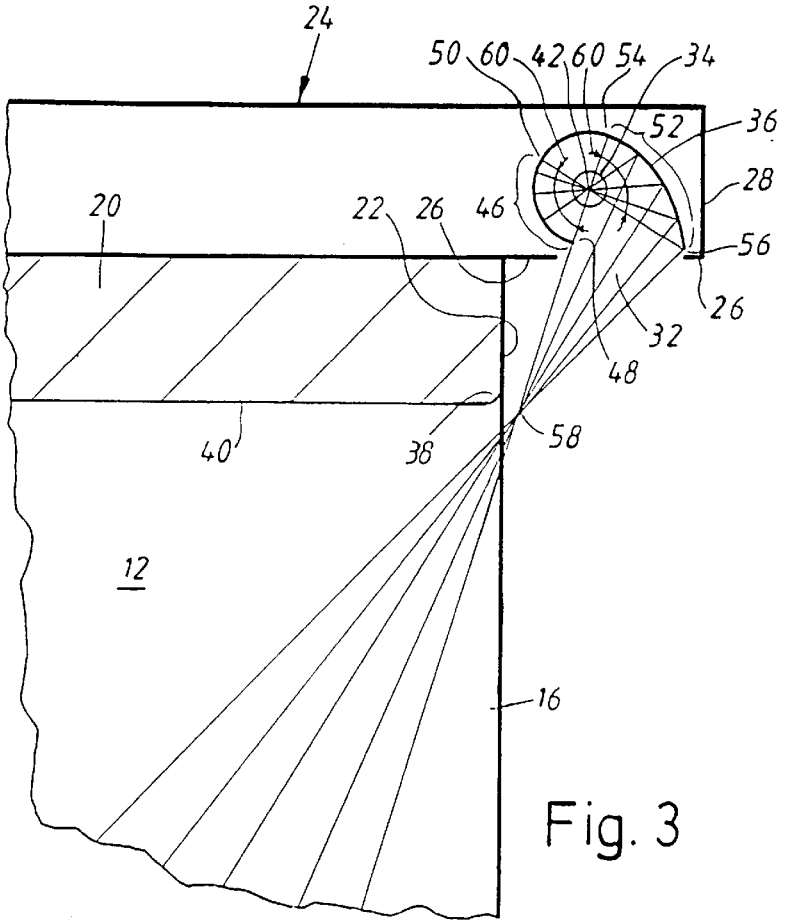
FIG. 3 is an enlargement of the area around the lamp in FIG. 1.

In the embodiment shown in FIG. 3, each one of the angles 60 which the first and second parts 46, 52 form with the filament 42 is shown to be about 100 degrees. Thus, the first and second reflector parts 46, 52 collect and reflect about 200/360=56% of the light from the filament 42 into the space 12.

Figure 4:
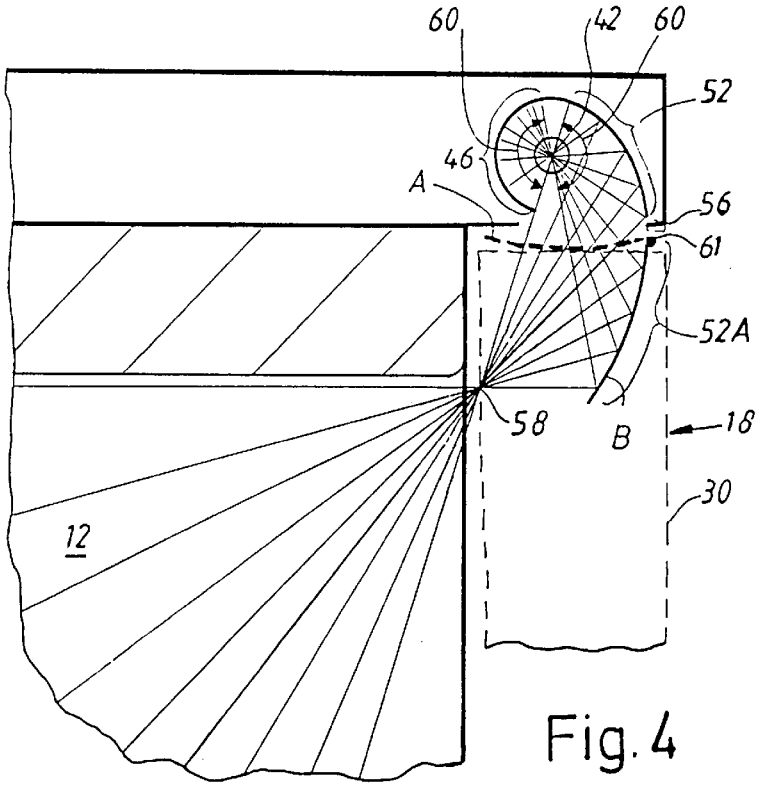
FIG. 4 illustrates a second embodiment of the present invention wherein the reflector includes a pivotal portion which is pivoted from a storage position to an operating position when a door to the space is opened.

With reference to FIG. 4, by extending the second part 52 with a folding elliptical-cylindrical part 52A, which in folded-down position also has its first and second focal points in the filament 42 and on the line 58, respectively, relatively more light can be directed into the cabinet. The folding part 52A is rotatably journalled around a horizontal axis 61 located at the fourth point 56 and pivotally moves from a relatively horizontal storage position A to a relatively vertical operating position B when the door 18 is opened. In this embodiment, the respective angle 60 is about 150 degrees. Accordingly, the parts 46, 52, and 52A will reflect about 300/360=83% of the light from the filament 42 into the space 12.

Figure 5:
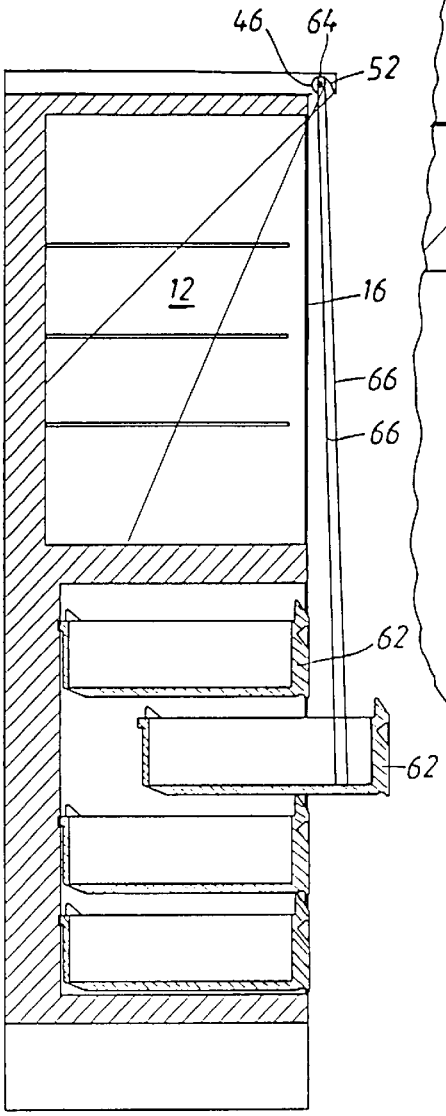
FIG. 5 is a vertical sectional view illustrating a third embodiment of the present invention, wherein a portion of the reflector is shaped to direct light from the lamp down into an extendable drawer.
Figure 6:
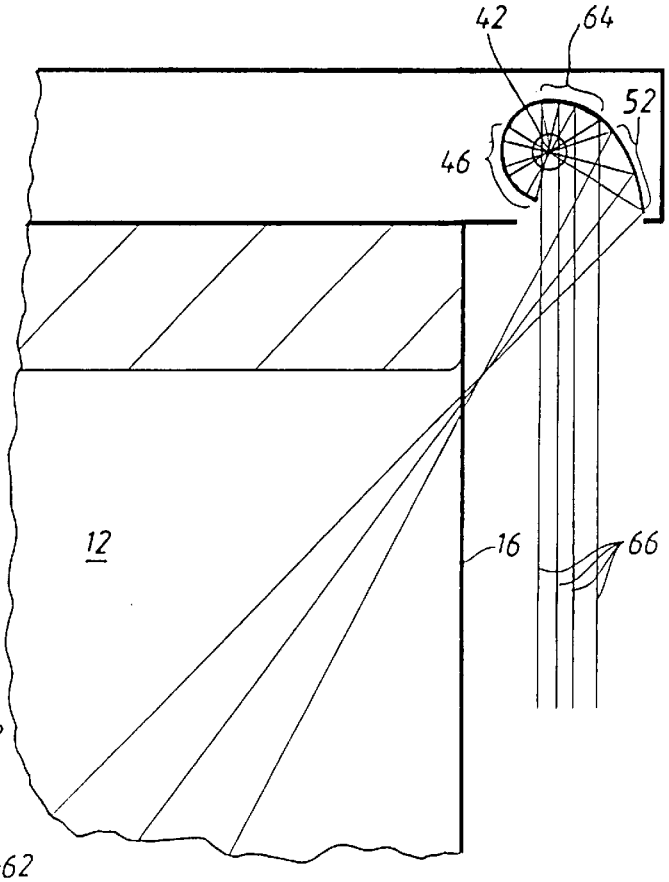
FIG. 6 is an enlargement of the area around the lamp in FIG. 5.

In the embodiment shown in FIGS. 5–6, drawers 62 for goods are arranged under the space 12. In order to obtain illumination of such a drawer 62 when it is drawn out, a third or parabolic-cylindrical reflector part 64 with its focal point in the filament 42 is arranged between the circular-cylindrical reflector part 46 and the elliptical-cylindrical reflector part 52. The third or parabolic reflector part 64 reflects a beam of parallel light rays 66 down into the drawer 62 past the opening 16. The third part 64 is semi-parabolic in cross section.

Figure 7:
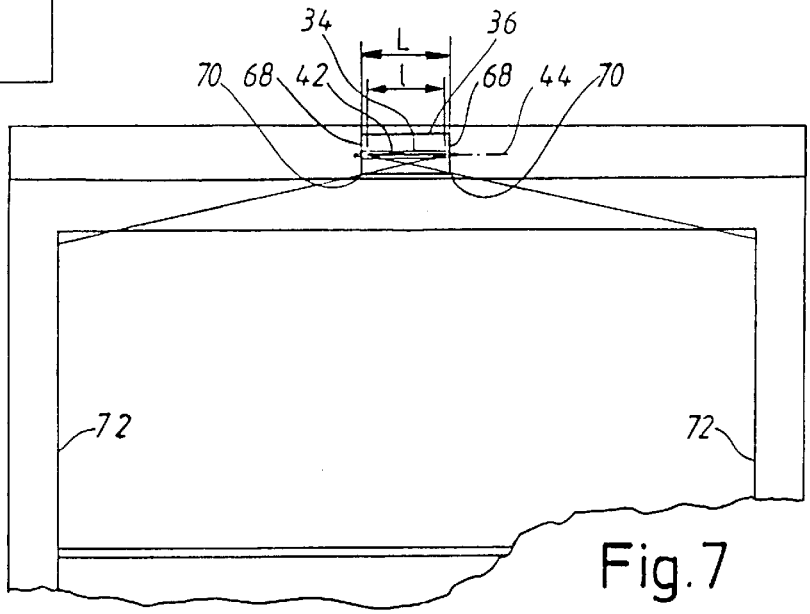
FIG. 7 illustrates a sectional view similar to FIG. 2, but wherein the lamp is constituted by a halogen lamp with a relatively, long line-shaped filament.

The lamp 34 can also be shaped such that the filament 42 will extend along a greater part 1 of the length L of the reflector 36, as shown in FIG. 7. The reflector 36 is provided with gables 68 (see also FIG. 2) with lower edges 70 located such that, relative to the filament 42 and the reflector 36, the light from the filament and the reflector hits the two vertical limiting edges 72 of the opening 16 at the same height. The lamp 34 does not need to be of halogen type but can also be of usual glow lamp type.

While the preferred embodiment of the present invention is shown and described herein, it is to be understood that the same is not so limited but shall cover and include any and all modifications thereof which fall within the purview of the invention.

We claim:

1. Refrigerator or freezer cabinet (10) with a lamp (34) which, by means of a reflector (36) with a cylindric reflection surface, illuminates a storage space (12) for goods in the cabinet, said reflector (36) having a downwardly facing opening (32), said lamp being arranged relatively forwardly and above a horizontal edge (38) of a vertical access opening (16) to the space and above said downward facing opening (32) such that said lamp illuminates the space through the downward facing opening (32) and the access opening, wherein a first portion (52) of the reflector (36) has a semi-elliptical cross-sectional shape with first and second focal points (42, 58), a concave side of said first portion facing said access opening, the lamp (34) having a filament (42) defining a first line (44) extending parallel to the edge (38) and through said first focal point (42), said second focal point (58) being located adjacent and outside the edge (38) so that light is directed past the edge into the space, whereby light from the filament (42) is reflected by said first portion (52) of the reflector (36) and passes through the second focal point (58) and then into the space (12).

2. Cabinet according to claim 1, wherein the reflector (36) has a second portion (46), said second portion having a semi-circular cross-sectional shape and having a center on the filament (42), said second portion (46) having a concave side facing away from said access opening (16), said second portion (46) receiving a portion of light which does not radiate directly from the filament (42) to the first portion (52) and reflects this light toward said first portion (52).

3. Cabinet according to claim 2, wherein the reflector (36) includes a third portion (64), said third portion having a semi-parabolic cross-sectional shape and having a focal point at the filament (42), said third portion (64) having a concave side facing downward, said third portion being located between and adjoining said first and second portions of the reflector, said third portion receiving light from the filament (42) and downwardly reflecting a beam of parallel light rays (66) directly through said downward facing opening (32).

4. Cabinet according to claim 3, further comprising at least one drawer (62) which is extendable from the space, wherein the beam of parallel light rays (66) shines directly into the drawer (66) from said third portion (64) when said drawer is extended.

5. Cabinet according to any one of claims 1–4, wherein said first portion of the reflector includes a fixed part (52) and an extension part (52A), said extension part hanging down from and pivotally arranged relative to the fixed part at an outer edge of said downward facing opening, said extension part being adapted to be pivoted from an operating position to a storage position by a door (18) of the access opening (16), when the door (18) is closed.

6. Cabinet according to claim 1, wherein said downward facing opening has inner and outer edges and said inner edge is defined by an imaginary line extending through said first and second focal points.

7. Cabinet according to claim 2, wherein said first and second portions form a total effective angle with said filament of about 200 degrees.

8. Cabinet according to claim 5, wherein said first and second portions form a total effective angle with said filament of about 300 degrees.

* * * * *